US010519990B2

(12) United States Patent
Owada et al.

(10) Patent No.: US 10,519,990 B2
(45) Date of Patent: Dec. 31, 2019

(54) HYDRAULIC APPARATUS

(71) Applicant: YANMAR CO., LTD., Osaka-shi, Osaka (JP)

(72) Inventors: Kazuhiro Owada, Amagasaki (JP); Keishi Yamanaka, Osaka (JP); Kensuke Kaneda, Osaka (JP); Hidekazu Niu, Osaka (JP)

(73) Assignee: YANMAR CO., LTD., Osaka ( * ) Notice: Subject to any disclaimer, the term of this patent is extended or adjusted under 35 U.S.C. 154(b) by 142 days.

(21) Appl. No.: 15/315,119

(22) PCT Filed: Mar. 26, 2015

(86) PCT No.: PCT/JP2015/059508
§ 371 (c)(1),
(2) Date: Nov. 30, 2016

(87) PCT Pub. No.: WO2015/186414
PCT Pub. Date: Dec. 10, 2015

(65) Prior Publication Data

US 2017/0198730 A1 Jul. 13, 2017

(30) Foreign Application Priority Data

Jun. 2, 2014 (JP) ..... 2014-114451

(51) Int. Cl.
*F15B 21/14* (2006.01)
*E02F 9/22* (2006.01)
(Continued)

(52) U.S. Cl.
CPC ..... *F15B 21/14* (2013.01); *E02F 9/2075* (2013.01); *E02F 9/2217* (2013.01);
(Continued)

(58) Field of Classification Search
CPC ..... F15B 11/04; F15B 11/17; F15B 21/14; E02F 9/2232; E02F 9/2271; E02F 9/2075
See application file for complete search history.

(56) References Cited

U.S. PATENT DOCUMENTS 6,912,849 B2 * 7/2005 Inoue ..... E02F 9/2217 417/225
6,915,600 B2 7/2005 Kondou
(Continued)

FOREIGN PATENT DOCUMENTS

CN 1333435 A 1/2002
JP H10169547 A 6/1998
(Continued)

OTHER PUBLICATIONS

International Search Report corresponding to Application No. PCT/JP2015/059508; dated Jun. 23, 2015, with English translation.
(Continued)

*Primary Examiner* — Abiy Teka
(74) *Attorney, Agent, or Firm* — Norton Rose Fulbright US LLP

(57) ABSTRACT

The hydraulic apparatus is set so that the ratio of the pressure-receiving area of the respective bottom oil chambers of the boom cylinder, the arm cylinder and the bucket cylinder to the pressure-receiving area of the respective rod oil chambers matches the ratio of the extruded volume drawn into or discharged from the bottom oil chambers per single rotation by the respective extrusion members of the first hydraulic pump motor, the second hydraulic pump motor and the third hydraulic pump motor to the volume discharged from or drawn into the rod oil chambers.

20 Claims, 12 Drawing Sheets

(51) Int. Cl.

| | |
|---|---|
| ***F15B 11/04*** | (2006.01) |
| ***F15B 11/17*** | (2006.01) |
| ***E02F 9/20*** | (2006.01) |
| ***F04B 1/20*** | (2006.01) |
| ***F04B 49/00*** | (2006.01) |
| ***F15B 7/00*** | (2006.01) |
| *E02F 3/32* | (2006.01) |
| *E02F 3/40* | (2006.01) |
| *E02F 9/08* | (2006.01) |
| *F04C 2/18* | (2006.01) |
| *F04C 2/344* | (2006.01) |

(52) U.S. Cl.

CPC ..... *E02F 9/2232* (2013.01); *E02F 9/2235* (2013.01); *E02F 9/2271* (2013.01); *E02F 9/2289* (2013.01); *E02F 9/2292* (2013.01); *E02F 9/2296* (2013.01); *F04B 1/20* (2013.01); *F04B 1/2042* (2013.01); *F04B 49/002* (2013.01); *F15B 7/006* (2013.01); *F15B 11/04* (2013.01); *F15B 11/17* (2013.01); *E02F 3/325* (2013.01); *E02F 3/401* (2013.01); *E02F 9/0883* (2013.01); *E02F 9/2004* (2013.01); *E02F 9/2267* (2013.01); *E02F 9/2275* (2013.01); *F04C 2/18* (2013.01); *F04C 2/3442* (2013.01); *F15B 2211/20515* (2013.01); *F15B 2211/20523* (2013.01); *F15B 2211/20538* (2013.01); *F15B 2211/20546* (2013.01); *F15B 2211/20561* (2013.01); *F15B 2211/20569* (2013.01); *F15B 2211/20576* (2013.01); *F15B 2211/2656* (2013.01); *F15B 2211/27* (2013.01); *F15B 2211/633* (2013.01); *F15B 2211/6346* (2013.01); *F15B 2211/6651* (2013.01); *F15B 2211/6652* (2013.01); *F15B 2211/7053* (2013.01); *F15B 2211/71* (2013.01); *F15B 2211/7142* (2013.01); *F15B 2211/75* (2013.01); *F15B 2211/77* (2013.01); *F15B 2211/88* (2013.01)

(56) References Cited

U.S. PATENT DOCUMENTS

| | | | | |
|---|---|---|---|---|
| 6,962,050 | B2 * | 11/2005 | Hiraki | E02F 9/2217 60/414 |
| 6,971,195 | B2 | 12/2005 | Kondou | |
| 8,544,264 | B2 | 10/2013 | Anderson | |
| 9,057,389 | B2 * | 6/2015 | Opdenbosch | E02F 9/2217 |
| 2003/0188530 | A1 | 10/2003 | Inoue et al. | |
| 2004/0083629 | A1 | 5/2004 | Kondou | |
| 2005/0144941 | A1 | 7/2005 | Kondou | |
| 2008/0223028 | A1 | 9/2008 | Anderson | |

FOREIGN PATENT DOCUMENTS

| | | | | |
|---|---|---|---|---|
| JP | 2002349505 | A | 12/2002 | |
| JP | 2004003612 | A | 1/2004 | |
| JP | 2004176893 | A | 6/2004 | |
| JP | WO 2009125505 | A1 * | 10/2009 | E02F 9/2235 |
| JP | 4569940 | B2 | 10/2010 | |
| JP | 2011196116 | A | 10/2011 | |
| WO | 2009125505 | A1 | 10/2009 | |
| WO | 2012034780 | A1 | 3/2012 | |

OTHER PUBLICATIONS

Extended European Search Report corresponding to Application No. 15803235.9-1018/3150861 PCT/JP2015059508; dated Jan. 8, 2018.

Chinese Office Action dated Nov. 1, 2017 issued in corresponding Chinese Application 201580030297.9.

* cited by examiner

HYDRAULIC APPARATUS

This is the U.S. national stage of application No. PCT/JP2015/059508, filed on Mar. 26, 2015. Priority under 35 U.S.C. § 119(a) and 35 U.S.C. § 365(b) is claimed from Japanese Application No. 2014-114451, filed Jun. 2, 2014, the disclosure of which is also incorporated herein by reference.

TECHNICAL FIELD

The present invention relates to an art for reducing a power loss of a hydraulic shovel.

BACKGROUND ART

An open center hydraulic circuit (for example, see Patent Document 1) and a load sensing hydraulic circuit (for example, see Patent Document 2) have been used to drive a boom cylinder, an arm cylinder, a bucket cylinder, or the like of a small hydraulic shovel.

The open center hydraulic circuit however always requires a maximum flow rate during an operation and thus has a large power loss especially during traveling at a very low speed. Meanwhile, the load sensing hydraulic circuit causes pressure interference during a combined operation and thus has poor operability and a large power loss. Moreover, both the hydraulic circuits are not able to collect energy by the cylinder operated by a gravitational force.

PRIOR ART DOCUMENTS

Patent Documents

Patent Document 1: JP-B 1 4569940 Gazette
Patent Document 2: JP-A 2011-196116 Gazette

SUMMARY OF THE INVENTION

Problems to be Solved by the Invention

The present invention is made to solve the aforementioned problem. An object of the present invention is to provide a hydraulic shovel (backhoe) in which each hydraulic cylinder of a boom cylinder, an arm cylinder, and a bucket cylinder are connected to an independent hydraulic pump/motor respectively via a closed circuit to avoid pressure interference during a combined operation, thereby offering improved operability and a reduced power loss.

Solutions to the Problems

An aspect of the present invention includes: double-acting single-rod cylinders, which are a boom cylinder, an arm cylinder, and a bucket cylinder; and rotationally driven hydraulic pump/motors, which are a first hydraulic pump/motor, a second hydraulic pump/motor, and a third hydraulic pump/motor, wherein discharge/suction ports of the boom cylinder communicate with discharge/suction ports of the first hydraulic pump/motor via oil lines to constitute a closed hydraulic oil circuit, discharge/suction ports of the arm cylinder communicate with discharge/suction ports of the second hydraulic pump/motor via oil lines to constitute a closed hydraulic oil circuit, and discharge/suction ports of the bucket cylinder communicate with discharge/suction ports of the third hydraulic pump/motor via oil lines to constitute a closed hydraulic oil circuit, and for each of the boom cylinder, the arm cylinder, and the bucket cylinder, a ratio of a pressed-area in a bottom oil chamber to the pressed-area in a rod oil chamber is set identical to a ratio of an amount of hydraulic oil suctioned into or discharged from the bottom oil chamber to an amount of hydraulic oil discharged from or suctioned into the rod oil chamber by a single revolution of a pushing member of corresponding one of the first hydraulic pump/motor, the second hydraulic pump/motor, and the third hydraulic pump/motor.

An aspect of the present invention is such that rotating shafts of the first hydraulic pump/motor, the second hydraulic pump/motor, and the third hydraulic pump/motor are respectively coupled to driving shafts of the first motor generator, the second motor generator, and the third motor generator to be driven, and the boom cylinder, the arm cylinder, and the bucket cylinder can independently be driven and can independently regenerate energy.

An aspect of the present invention is such that the first hydraulic pump/motor, the second hydraulic pump/motor, and the third hydraulic pump/motor are coupled to a single driving shaft coupled to an output shaft of an engine or a motor, the first hydraulic pump/motor, the second hydraulic pump/motor, and the third hydraulic pump/motor each being an axial piston hydraulic pump/motor including a movable swash plate, an operating speed and a direction of motion, extending or contracting, of the boom cylinder, the arm cylinder, and the bucket cylinder are changed by tilting the movable swash plates, and when the cylinder contracts by a load or a gravitational force, hydraulic oil is supplied to the first hydraulic pump/motor, the second hydraulic pump/motor, or the third hydraulic pump/motor to output energy.

An aspect of the present invention is such that, when at least one of the first hydraulic pump/motor, the second hydraulic pump/motor, and the third hydraulic pump/motor is driven by an engine or a motor and at least one of other hydraulic pump/motors is driven by pressurized oil from the cylinder extending and contracting by a load or a gravitational force to regenerate energy, the regenerated energy is used for assisting the engine or the motor or charging.

Effects of the Invention

According to the present invention, each hydraulic cylinder of a boom cylinder, an arm cylinder, and a bucket cylinder is operated by an independent hydraulic pump/motor to avoid pressure interference during a combined operation, thereby offering improved operability and a reduced power loss.

EMBODIMENTS OF THE INVENTION

Figure 1:
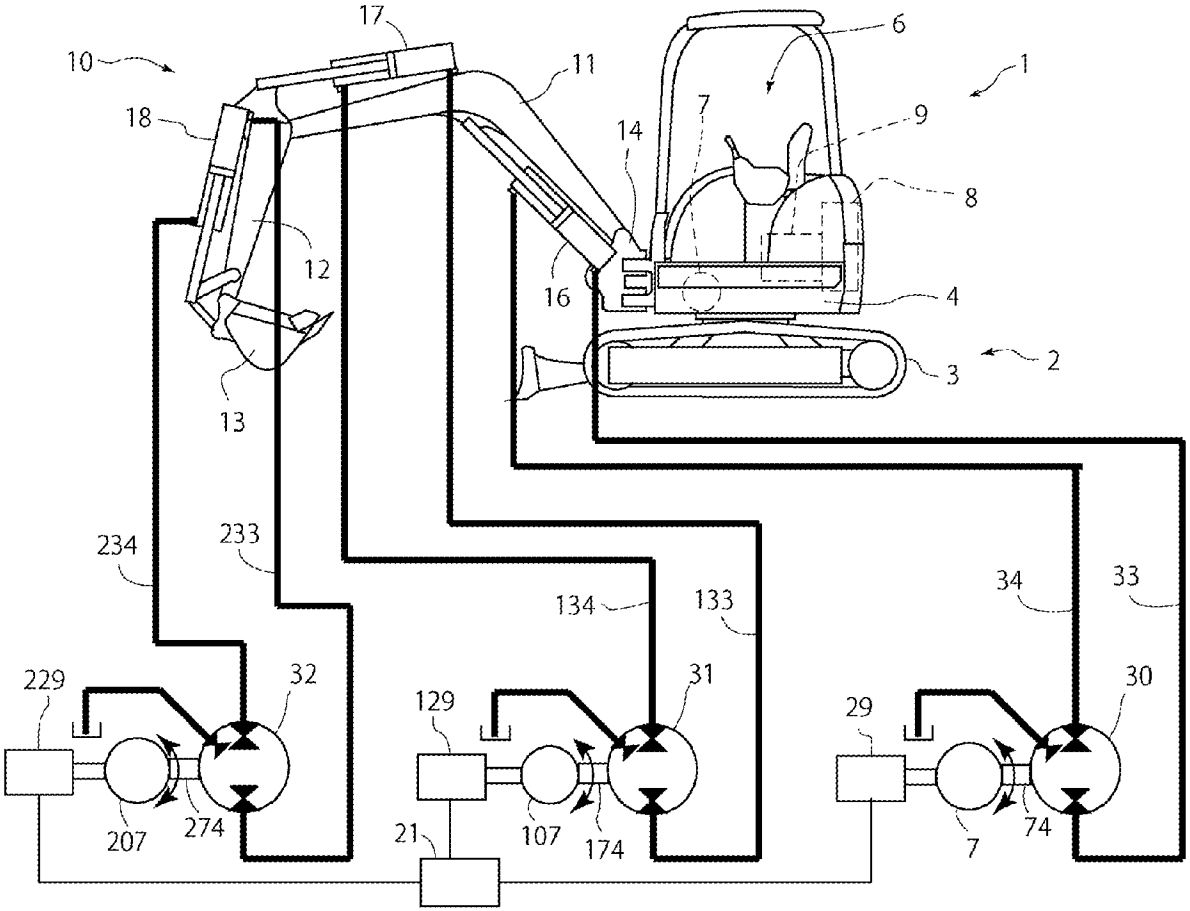
FIG. 1 illustrates connection between a backhoe and hydraulic apparatuses.

A general configuration of a backhoe (hydraulic shovel) 1 including a hydraulic apparatus according to the present invention will now be described with reference to FIG. 1.

The backhoe 1 includes a travel unit 2 including a pair of right and left travel crawlers 3, 3 and a swing unit (machine body) 4 swingably mounted on the travel unit 2.

The swing unit 4 includes an operating section 6, motor generators 7, 107, and 207 serving as driving sources, a battery 8 that supplies power to the motor generators 7, 107, and 207 and stores regenerated electric energy, and an oil tank 9 storing hydraulic oil. A working unit 10 including a boom 11, an arm 12, and a bucket 13 for excavation is provided in the front part of the swing unit 4.

The boom 11 constituting the working unit 10 has a bent shape, in a side view, projecting forward its distal end. The proximal end of the boom 11 is pivotally joined to a boom bracket 14 mounted on the front part of the swing unit 4. A boom cylinder 16 is disposed on the front face of the boom 11. The boom cylinder 16 is a double-acting single-rod cylinder that swings the boom 11 upward and downward. The bottom end of the boom cylinder 16 is pivotally joined to the front end of the boom bracket 14. The rod end of the boom cylinder 16 is pivotally joined to the front face (concave side) of the bent section of the boom 11.

The proximal end of the arm 12 is pivotally joined to the distal end of the boom 11. An arm cylinder 17 for swinging the arm 12 is disposed on the top face of the front part of the boom 11. The arm cylinder 17 is a double-acting single-rod cylinder. The bottom end of the arm cylinder 17 is pivotally joined to the back face of the bent section of the boom 11. The rod end of the arm cylinder 17 is pivotally joined to the proximal face (front face) of the arm 12.

The bucket 13, which is an attachment for excavation, is pivotally joined to the distal end of the arm 12. A bucket cylinder 18 for swinging the bucket 13 is disposed on the outer face (front face) of the arm 12. The bucket cylinder 18 is a double-acting single-rod cylinder. The bottom end of the bucket cylinder 18 is pivotally joined to the proximal portion of the arm 12. The rod end of the bucket cylinder 18 is pivotally joined to the bucket 13 via a connecting link.

A hydraulic circuit connecting the hydraulic cylinder (the boom cylinder 16, the arm cylinder 17, and the bucket cylinder 18) and the hydraulic pump/motor (a first hydraulic pump/motor 30, a second hydraulic pump/motor 31, and a third hydraulic pump/motor 32) will now be described with reference to FIG. 1.

Inflow/outflow ports of the boom cylinder 16 communicate with discharge/suction ports of the first hydraulic pump/motor 30 via a first oil line 33 and a second oil line 34. Inflow/outflow ports of the arm cylinder 17 communicate with discharge/suction ports of the second hydraulic pump/motor 31 via a first oil line 133 and a second oil line 134. Inflow/outflow ports of the bucket cylinder 18 communicate with discharge/suction ports of the third hydraulic pump/motor 32 via a first oil line 233 and a second oil line 234. The first hydraulic pump/motor 30, the second hydraulic pump/motor 31, and the third hydraulic pump/motor 32 have capacities corresponding to the respective sizes and capacities of those of the boom cylinder 16, the arm cylinder 17, and the bucket cylinder 18. As will be described below, the ratio of the amount of hydraulic oil suctioned into or discharged from a bottom oil chamber to the amount of hydraulic oil discharged from or suctioned into a rod oil chamber by a single revolution of a pushing member of corresponding one of the first hydraulic pump/motor 30, the second hydraulic pump/motor 31, and the third hydraulic pump/motor 32 is set identical. A check valve, a relief valve, or the like are provided between the first oil line 33 and the second oil line 34, between the first oil line 133 and the second oil line 134, and between the first oil line 233 and the second oil line 234.

A rotating shaft 74, a cylinder block 175, and a supporting shaft 274 of the first hydraulic pump/motor 30, the second hydraulic pump/motor 31, and the third hydraulic pump/motor 32 are respectively connected to driving shafts of motor generators 7, 107, and 207 to rotate together. The first motor generator 7, the second motor generator 107, and the third motor generator 207 are respectively connected to inverters 29, 129, and 229. The inverters 29, 129, and 229 are connected to a control circuit 21. The rotation of each of the motor generators 7, 107, and 207 can be controlled by controlling power supplied from the battery 8. The first motor generator 7, the second motor generator 107, and the third motor generator 207 can be rotated in normal and reverse directions at a variable speed.

When the boom cylinder 16, the arm cylinder 17, or the bucket cylinder 18 contracts by a load or a potential energy, the contraction causes the pressurized oil to flow to rotate the first hydraulic pump/motor 30, the second hydraulic pump/motor 31, or the third hydraulic pump/motor 32, thereby rotating the first motor generator 7, the second motor generator 107, or the third motor generator 207 to generate power which is stored in the battery 8 via the inverter 29, the inverter 129, or the inverter 229. Namely, regeneration can be performed.

The hydraulic circuit between the first hydraulic pump/motor 30 and the boom cylinder 16, the hydraulic circuit between the second hydraulic pump/motor 31 and the arm cylinder 17, and the hydraulic circuit between the third hydraulic pump/motor 32 and the bucket cylinder 18 are configured approximately the same. Hence, the configuration of the hydraulic circuit between the first hydraulic pump/motor 30 and the boom cylinder 16 (hereinafter referred to as a hydraulic cylinder 16) will now be described with reference to FIG. 2.

As mentioned above, the hydraulic cylinder 16 is a double-acting single-rod cylinder that has a pressed-area B (sectional area) in a bottom oil chamber 35 larger than a pressed-area R in a rod oil chamber 36 by a sectional area Q of a piston rod 37. Thus, the following relationship is given.

(pressed-area B in bottom oil chamber 35)=(pressed-area R in rod oil chamber 36)+(sectional area Q of piston rod 37)

A circuit 61 including two relief valves 64 and 65 and two check valves 66 and 67 is disposed between the first oil line 33 and the second oil line 34 providing communication between the inflow/outflow ports of the hydraulic cylinder 16 and the discharge/suction ports of the first hydraulic pump/motor 30. When the pressure in the oil line 33 (34) becomes excessively high, the circuit 61 stops supplying the hydraulic oil to the oil chamber 35 (36) of the hydraulic cylinder 16 and instead guides the hydraulic oil to the oil line 34 (33) or to the oil tank 9 to prevent an excessive load on the hydraulic apparatus.

The embodiment is provided with a bypass oil line 62 connecting the first oil line 33 and the second oil line 34. The bypass oil line 62 is provided with the first relief valve 64 for dropping the pressure (releasing the hydraulic oil) in the first oil line 33, the second relief valve 65 for dropping the pressure (releasing the hydraulic oil) in the second oil line 34, the first check valve 66 allowing the hydraulic oil to flow only in the direction from the first oil line 33 to the second oil line 34, and the second check valve 67 allowing the hydraulic oil to flow only in the opposite direction. An end of the drain oil line 63 is connected to the bypass oil line 62 at between the relief valves 64 and 65 and between the check valves 66 and 67. The other end of the drain oil line 63 is connected to the oil tank 9.

Figure 3:
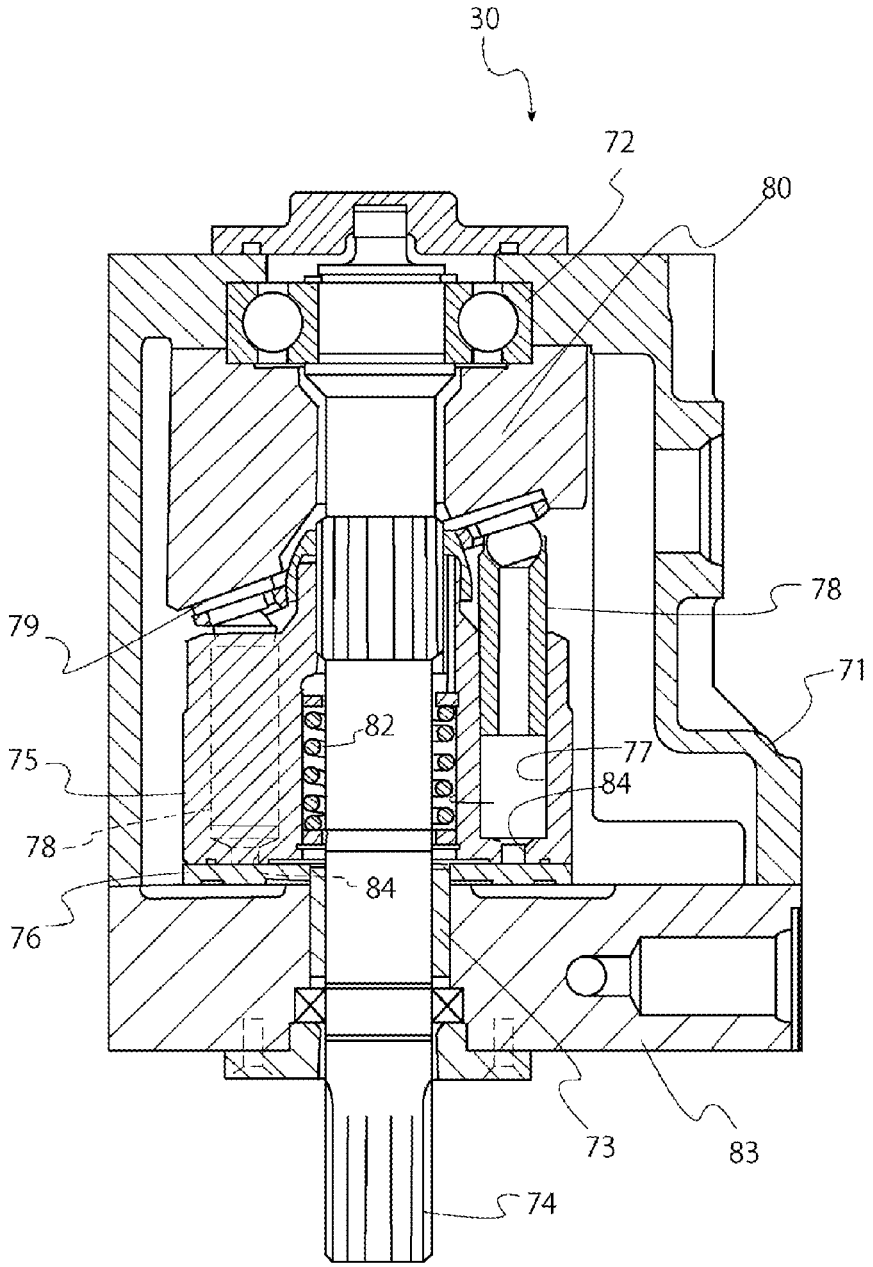
FIG. 3 is a side sectional view of a hydraulic pump/motor.

The first hydraulic pump/motor 30, the second hydraulic pump/motor 31, and the third hydraulic pump/motor 32 are rotationally driven hydraulic pump/motors each of which capacity is changed by slidably revolving a pushing member. As illustrated in FIG. 3, the hydraulic pump/motor in the first embodiment is an axial piston hydraulic pump/motor including pistons 78 serving as the pushing members disposed around and parallel to the rotating shaft 74. The hydraulic pump/motors of a second embodiment (see FIG. 6) and a third embodiment (see FIG. 7) are radial piston hydraulic pump/motors including plungers 178 serving as the pushing members disposed in radial directions with respect to an axis eccentric to the rotating shaft 74. The hydraulic pump/motor of a fourth embodiment (see FIG. 8) is a vane hydraulic pump/motor including vanes 278 serving as the pushing members. The hydraulic pump/motor of a fifth embodiment (see FIGS. 9 and 10) is a gear hydraulic pump/motor including gears 473*a*, 473*b*, 476*a*, and 476*b* serving as the pushing members.

The first hydraulic pump/motor 30, the second hydraulic pump/motor 31, and the third hydraulic pump/motor 32 that are each configured as an axial piston hydraulic pump/motor will now be described. Since the first hydraulic pump/motor 30, the second hydraulic pump/motor 31, and the third hydraulic pump/motor 32 all have the same configuration, the description will be made for the first hydraulic pump/motor 30 (hereinafter referred to as hydraulic pump/motor 30).

Figure 4:
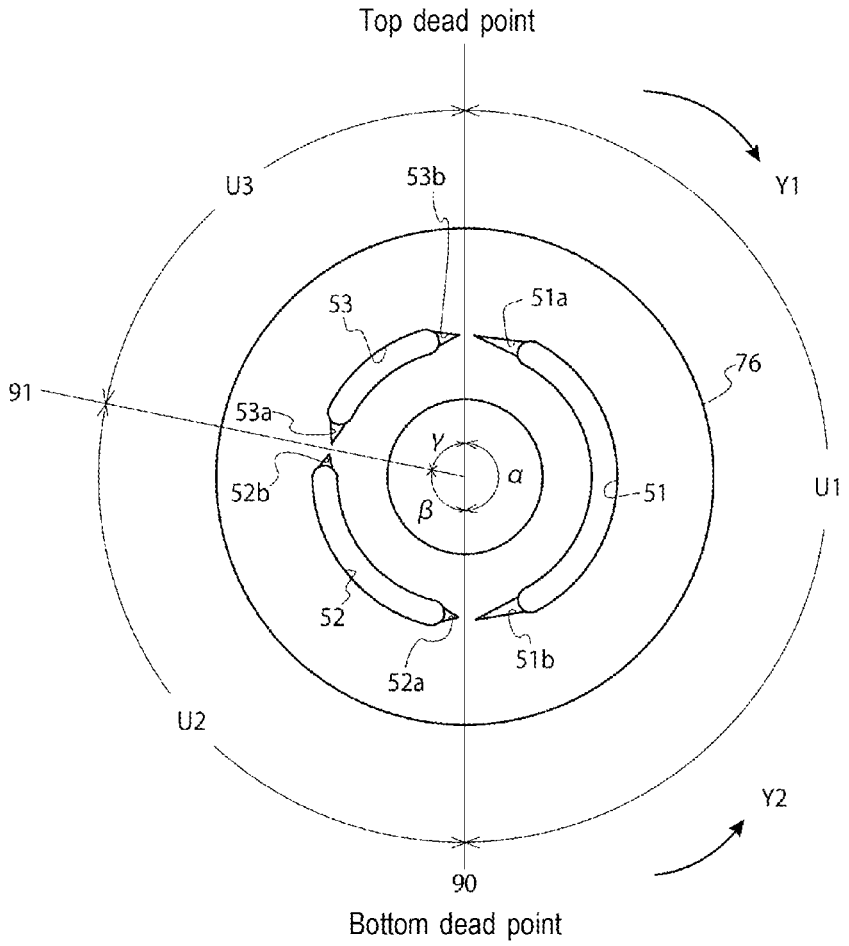
FIG. 4 is a front view of a valve plate.

As illustrated in FIGS. 3 and 4, the hydraulic pump/motor 30 includes a rotating shaft 74 rotatably supported via the bearings 72 and 73 in a housing body 71 having a hollow box-shape, a cylinder block 75 spline-coupled to the rotating shaft 74 to rotate together with the rotating shaft 74, a valve plate 76 including a plurality of ports 51, 52, and 53, and an oil line block 83 that includes an oil line and plugs the opened end of the housing body 71. The rotating shaft 74 penetrates the oil line block 83, or the housing body 71, with an end protruding outside to be coupled to an output shaft of the motor generator 7. The cylinder block 75 has a plurality of cylinder chambers 77 arranged on the same circle about the center of the rotating shaft 74, each cylinder chamber 77 extending parallel to the rotating shaft 74. Each piston 78, 78 . . . is disposed in each cylinder chamber 77 in a manner allowed to slidably reciprocate.

A fixed swash plate 80 is disposed near the bearing 72 (in the upper portion) inside the housing body 71. Piston shoes 79 are provided on the fixed swash plate 80 to oppose the cylinder block 75. The distal end of each piston 78 is in contact (or engaged) with the piston shoe 79.

A compressed spring 82 fitted on (spline-engaged with) the rotating shaft 74 is disposed in a shaft hole provided in the axial center of the cylinder block 75. By the compressed spring 82 (pushing force), the piston shoe 79 is pushed against a piston slide face of the fixed swash plate 80.

The oil line block 83 is detachably attached to the bottom of the housing body 71. The valve plate 76 is disposed between the upper face of the oil line block 83 and the cylinder block 75 with the rotating shaft 74 penetrating the valve plate 76. The valve plate 76 is secured to the oil line block 83. The cylinder block 75 in face-contact with the valve plate 76 rotates together with the rotating shaft 74. The oil line block 83 includes oil lines, such as the bypass oil line 62 and the drain oil line 63, and is provided with relief valves 64 and 65 and check valves 66 and 67.

Communication holes 84 are provided in the cylinder block 75 to open to the end face which the valve plate 76 is in contact with. Each communication hole 84 communicates with the cylinder chamber 77. As the cylinder block 75 rotates, each communication hole 84 selectively communicates with ports 51, 52, and 53, which will be described later, of the valve plate 76. Which means that, the communication holes 84 and the ports 51, 52, and 53 are opened at the same distance from the axial center of the rotating shaft 74.

As illustrated in FIG. 4, the valve plate 76 is provided with three ports 51, 52, and 53 penetrating the valve plate 76 in the thickness direction. The three ports 51, 52, and 53, provided with a space therebetween, are long arc slits of the same width formed along the same circle about the center of the rotating shaft 74.

Figure 2:
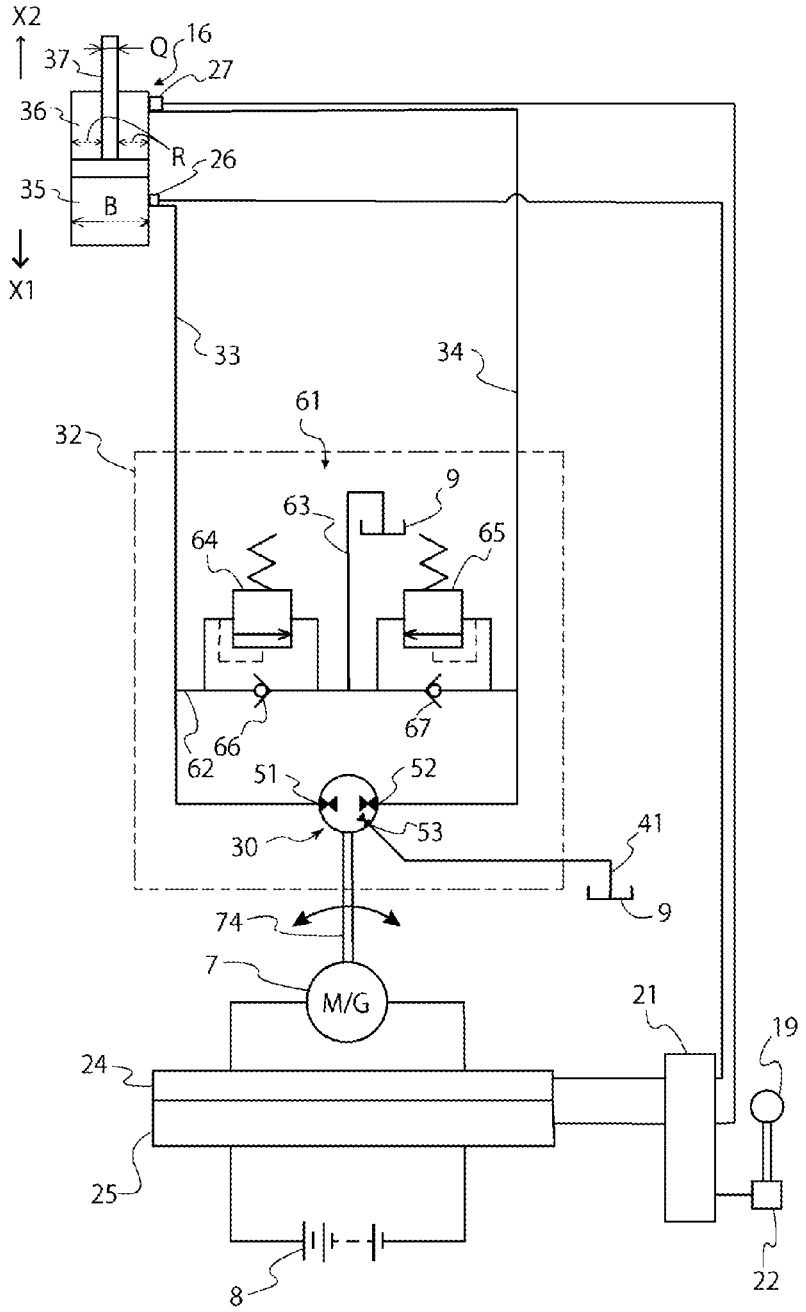
FIG. 2 illustrates a hydraulic circuit of the hydraulic apparatus.

As illustrated in FIG. 2, the first port 51 communicates with the bottom oil chamber 35 of the hydraulic cylinder 16 via the first oil line 33. The second port 52 communicates with the rod oil chamber 36 of the hydraulic cylinder 16 via the second oil line 34. The third port 53 is connected to the oil tank 9 via the third oil line 41.

As illustrated in FIG. 4, the first port 51, the second port 52, and the third port 53 are provided on the valve plate 76. Each of the ports is provided in one of a plurality of designated sections so that the direction of oil supply (discharge or suction) can be changed according to the angle. That is, the valve plate 76 has three designated sections each extending in a predetermined angle about the center of the rotating shaft. The full angle (360 degrees) is sectioned into designated sections which are a first designated section U1 (with an angle $\alpha$), a second designated section U2 (with an angle $\beta$), and a third designated section U3 (with an angle $\gamma$) in this order from the top dead point clockwise (in the direction indicated by Y1). Thus, the following relationship is given.

$$\text{angle } \beta + \text{angle } \gamma = \alpha = 180 \text{ degrees.}$$

Now, let a standard switching point 90 be given by the line connecting the bottom dead point and the top dead point and a first switching point 91 be given at a location $\beta$ degrees from the standard switching point 90, which is the bottom dead point, to determine the second designated section U2 between the standard switching point 90 and the first switching point 91. Let another standard switching point 90 be given at a location $\gamma$ degrees from the first switching point 91 to determine the third designated section U3 between the first switching point 91 and the standard switching point 90.

The first port 51 is provided in the first designated section U1 on the valve plate 76, the second port 52 is provided in the second designated section U2 on the valve plate 76, and the third port 53 is provided in the third designated section U3 on the valve plate 76. Note that, the second designated section U2 where the second port 52 is provided and the third designated section U3 where the third port 53 is provided can be arranged in the opposite order with respect to the rotational direction. Namely, the first designated section U1, the third designated section U3, and the second designated section U2 can be arranged in this order along Y1 direction.

The pressed-area R in the rod oil chamber 36 is smaller than the pressed-area B in the bottom oil chamber 35 by the sectional area Q of the piston rod 37 (R+Q=B). Without any adjustment, the amount of the hydraulic oil flowing out of the rod oil chamber 36 to return to the hydraulic pump/motor 30 is smaller than the amount of the hydraulic oil discharged from the hydraulic pump/motor 30 to flow into the bottom oil chamber 35, and thus cavitation occurs in the hydraulic pump/motor 30.

Meanwhile, in contraction of the hydraulic cylinder 16, the amount of the hydraulic oil flowing out of the bottom oil chamber 35 to return to the hydraulic pump/motor 30 is larger than the amount of the hydraulic oil discharged from the hydraulic pump/motor 30 to flow into the rod oil chamber 36. Without any adjustment, the hydraulic pump/motor 30 cannot suction the excess amount of the hydraulic oil, and thus the pressure in the first oil line 33 and the bottom oil chamber 35 rises and eventually the piston rod 37 stops. As described above, however, the third port 53 of the hydraulic pump/motor 30 is connected to the oil tank 9 via the third oil line 41, and thus the driven hydraulic pump/motor 30 can by itself discharge the excess amount of the hydraulic oil to the oil tank 9 via the third port 53 and the third oil line 41.

The amount of hydraulic oil discharged from the bottom oil chamber 35 cannot be set the same as the amount of hydraulic oil suctioned into the rod oil chamber 36 by only setting the ratio (angular ratio) of the second designated section U2 where the second port 52 is provided to the first designated section U1 where the first port 51 is provided identical to the ratio of the pressed-area R in the rod oil chamber 36 to the pressed-area B in the bottom oil chamber 35 of the hydraulic cylinder 16 ($U2/U1=R/B=\beta/\alpha$, where $U1=U2+U3$ and $\alpha=\beta+\gamma$).

Figure 5:
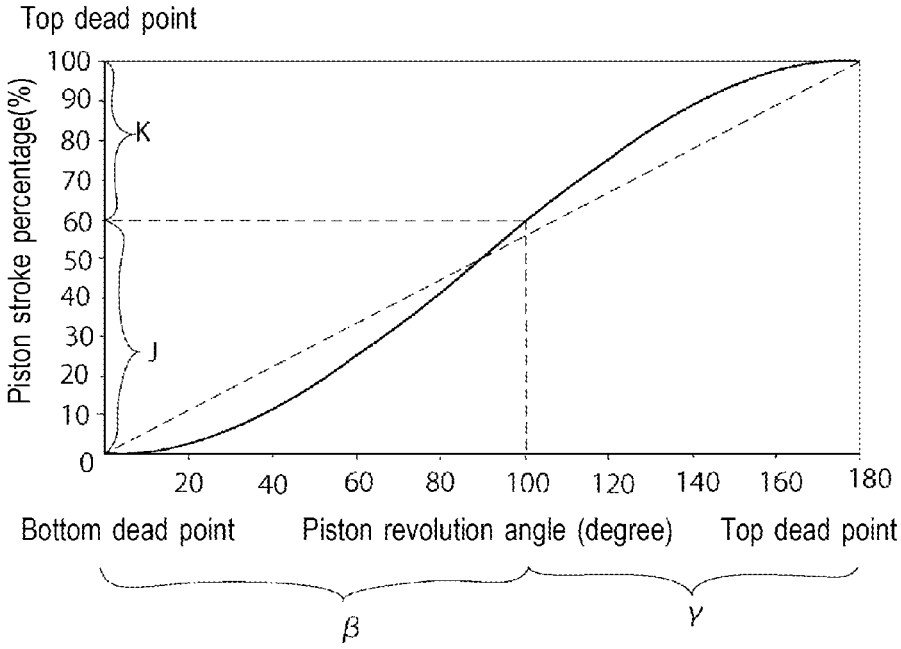
FIG. 5 illustrates a relationship between a revolution angle of a piston and a piston stroke percentage.

This will be explained with reference to FIG. 5. In FIG. 5, the horizontal axis represents the revolving angle of the piston 78 about the center of the rotating shaft 74, and the vertical axis represent the stroke percentage of the piston 78, where the stroke percentage is 100% when the piston 78 slides from the bottom dead point to the top dead point. The vertical axis may represent the capacity ratio from the bottom dead point to the top dead point. The relationship between the revolution angle and the stroke percentage of the piston 78 is such that, while the piston 78 accommodated in the cylinder chamber 77 in the cylinder block 75 revolves about the central axis of the rotating shaft 74 to slide from the bottom dead point to the top dead point, the stroke (movement per unit time) of the piston 78 is small in an initial stage of revolution but gradually increases as the piston 78 further revolves, reaching the maximum at 90 degrees, and then decreases as the piston 78 approaches the final stage of the revolution. This means that the relationship between the revolution angle and the stroke percentage of the piston 78 is not a direct proportional relationship but a point symmetric relationship (a sin curve). Thus, if the angle $\beta$ of the second designated section U2 and the angle $\gamma$ of the third designated section U3 on the valve plate 76 are respectively set to the ratios of the pressed-area R in the rod oil chamber 36 and the sectional area Q of the piston rod 37 to the pressed-area B in the bottom oil chamber 35 of the hydraulic cylinder 16, the amount of hydraulic oil discharged from the bottom oil chamber 35 does not match the amount of hydraulic oil suctioned into the rod oil chamber 36 and the excessive hydraulic oil flows into the oil tank 9, causing deterioration in efficiency. This also causes shortage in oil suctioned into the bottom oil chamber 35, which might create cavitation.

Now, as illustrated in FIGS. 4 and 5, let the stroke percentage of the piston 78 sliding from the bottom dead point to the top dead point be 100%, and the ratio of the pressed-area R in the rod oil chamber 36 to the pressed-area B in the bottom oil chamber 35 of the hydraulic cylinder 16 be, expressed in the same unit, a second stroke percentage J (%). Similarly, let the ratio of the sectional area Q of the piston rod 37 to the pressed-area B in the bottom oil chamber 35 be a third stroke percentage K (%) (J+K=100). The second designated section U2 has the angle $\beta$ which is the piston revolution angle corresponding to the second stroke percentage J. That is, the first switching point 91 is set at a point circumferentially shifted by the angle $\beta$ from the standard switching point 90 where the bottom dead point is stationed. In other words, the first switching point 91 is at a location circumferentially shifted by the angle $\gamma$ from the standard switching point 90 where the top dead point is stationed.

Along with the rotation of the cylinder block 75, the piston 78 revolving in the second designated section U2 (having the angle $\beta$) where the second port 52 is provided moves upward by J %. Let the amount of hydraulic oil suctioned (or forced out) through the second port 52 during this upward movement be M2. Then the piston 78 revolves in the third designated section U3 (having the angle $\gamma$) to move upward by K %. Let the amount of the hydraulic oil suctioned (or forced out) through the third port 53 during this upward movement be M3. The ratio of the amounts of hydraulic oil M2 to M3 is set identical to the ratio of the pressed-area R in the rod oil chamber 36 to the sectional area Q of the piston rod 37 ($M2/M3=R/Q$). Therefore, the amount of the hydraulic oil discharged from a single piston 78 in a 180-degree rotation of the cylinder block 75 is proportional to the capacity in the cylinder chamber 77 changing by the stroke or reciprocation of the piston 78. The efficiency is thereby improved and cavitation is prevented. Note that the third port may be divided into two and provided at both sides of the second port 52 with the stroke percentage of the piston corresponding to the revolving angle.

As illustrated in FIG. 4, triangular notches 51*a*, 51*b*, 52*a*, 52*b*, 53*a*, and 53*b* are provided on both ends in the revolving direction (circumferential direction) of the first port 51, the second port 52, and the third port. That is, each port is provided with notches at forward and rearward ends in the revolving direction of the cylinder block 75. The first port 51 is provided with the notches 51*a* and 51*b*, the second port 52 is provided with the notches 52*a* and 52*b*, and the third port 53 is provided with the notches 53*a* and 53*b*. The notches 51*a*, 51*b*, 52*a*, 52*b*, 53*a*, and 53*b* each has a width and depth decreasing toward its distal end.

The notches 52*a*, 52*b*, 53*a*, and 53*b* provided to the ends of each port prevent large fluctuation in the pressure caused by sudden inflow/outflow of the pressurized oil, that is, the inflow/outflow of the pressurized oil from the cylinder block 75 through the first port 51, the inflow/outflow of the pressurized oil from the hydraulic cylinder 16 through the second port 52, and the inflow/outflow of the pressurized oil from the oil tank 9 through the third port 53. With the pressurized oil gradually flowing in/out through the notches 51*a*, 51*b*, 52*a*, 52*b*, 53*a*, and 53*b*, the piston 78 will not slide suddenly, so that cavitation and noise will not occur.

In addition, the notches 52*a* and 52*b* have smaller circumferential lengths than the notches 53*a* and 53*b* (52*a*·52*b*<53*a*·53*b*<51*a*, 51*b*). This further minimizes cavitation and noise.

Contraction and Extension of the hydraulic cylinder 16 by the hydraulic apparatus will now be described.

In FIG. 2, a manipulation lever 19 is provided in the operating section 6. An angle sensor 22 that detects the motion of the manipulation lever 19 is provided on the proximal portion of the manipulation lever, and the angle sensor 22 is connected to the control circuit 21 serving as a control unit. The motor generator 7 is connected to a driving circuit 24 configured with an inverter, for example, and a charging circuit 25. The driving circuit 24 and the charging circuit 25 are connected to the control circuit 21. The motor 7 is selectively connected to the driving circuit 24 or the charging circuit 25 by the control circuit 21. When the manipulation lever 19 is turned, the turning direction and the turned angle are detected by the angle sensor 22 and input to the control unit 21. Signals corresponding to the turning direction and the turned angle are input to the driving circuit 24, and the driving circuit 24 rotationally drive the motor generator 7 according to the turning direction and the turned angle of the manipulation lever 19. By driving the motor 7, the hydraulic pump/motor 30 operates to supply the pressurized oil to the hydraulic cylinder 16 which thereby extends or contracts.

A pressure sensor 26 is provided on the oil line communicating with the bottom oil chamber 35 of the hydraulic cylinder 16 to detect the oil pressure in the bottom oil chamber 35. A pressure sensor 27 is provided on the oil line communicating with the rod oil chamber 36 to detect the oil pressure in the rod oil chamber 36. The pressure sensors 26 and 27 are connected to the control unit 21.

In this configuration, by turning the manipulation lever 19 in the operating section 6 in the direction to extend the hydraulic cylinder 16 (in X2 direction), the pressure sensor 26 detects oil pressure P1 in the bottom oil chamber 35 and the pressure sensor 27 detects oil pressure P2 in the rod oil chamber 36. If the manipulation lever 19 is turned in the direction for extension and the value detected by the pressure sensor 26 is larger than the value detected by pressure sensor 27 (P1>P2), the control unit 21 determines that a lifting work, not a regeneration, is performed and sends a driving signal to the driving circuit 24. Then the driving circuit 24 supplies power to the motor 7 to rotate the motor according to the tilt angle of the manipulation lever 19, thereby driving the hydraulic pump/motor 30 to extend the hydraulic cylinder 16.

By driving the motor 7 to rotate the rotating shaft 74 of the hydraulic pump/motor 30 in the Y1 direction (see FIG. 4), the cylinder block 75 integrally rotates with the rotating shaft 74 and the piston shoe 79 sliding against the piston slide face of the fixed swash plate 80. Each piston 78 slidably reciprocates in the cylinder chamber 77 along the tilt angle of the fixed swash plate 80, thereby changing the capacity in the cylinder chamber 77.

For example, as the piston 78 moves from the top dead point to the bottom dead point (revolves in the Y1 direction), the piston 78 moves downward to force the pressurized oil to flow via the communication hole 84 gradually into the first port 51 through the notch 51*a*. This minimizes an initial pressure rise and suppresses noise or the like created by a sudden movement of the piston 78. The pressurized oil is supplied to the bottom oil chamber 35 of the hydraulic cylinder 16 via the first port 51 and the first oil line 33 to extend the hydraulic cylinder 16.

Discharge of hydraulic oil stops as the piston 78 reaches the bottom dead point. As the cylinder block 75 further rotates, the hydraulic oil in the rod oil chamber 36 of the hydraulic cylinder 16 is gradually suctioned via the second oil line 34 through the notch 52*a*. In a similar manner, a sudden upward movement of the piston 78 is suppressed and thus noise or the like is suppressed. The hydraulic oil is then suctioned through the second port 52, thereby increasing the suctioned amount of hydraulic oil. If a shortage of hydraulic oil due to the capacity difference between the bottom oil chamber 35 and the rod oil chamber 36 occurs, the hydraulic oil is supplied from the oil tank 9 via the bypass oil line 62, the check valve 67, and the drain oil line 63 through the second port 52. As the piston 78 revolves from the bottom dead point by the angle β, suction through the second port 52 stops, and then the hydraulic oil in the oil tank 9 is gradually suctioned via the third oil line 41 through the notch 53*a*. This suppresses a sudden upward movement of the piston 78 and noise or the like. As the piston 78 further revolves, the hydraulic oil is suctioned through the third port 53R. As the piston 78 further revolves to reach the top dead point, the above-described operation is repeated.

As described above, switching between oil lines is performed using the valve plate 76 along with the rotation of the cylinder block 75, sequentially performing the suction step and the discharge step in each cylinder chamber 77 by upward and downward movement of the piston 78.

The regeneration will now be described.

When the manipulation lever 19 is turned in the direction to contract the hydraulic cylinder 16 (in the X1 direction) to lower the boom 11 (for example, the arm 12 or the bucket 13) by its own weight from a raised position, the boom 11 can be lowered without operating the motor generator 7 and the energy produced by lowering the boom 11 can be converted into electric power and then stored. That is, if the control circuit 21 detects that the manipulation lever 19 is turned to perform a lowering operation and the value detected by the pressure sensor 26 is larger than the value detected by the pressure sensor 27 (P1>P2), the control circuit 21 determines that regeneration is to be performed and switches the circuit from the driving circuit 24 to the charging circuit 25. The hydraulic pump/motor 30 now operates as a hydraulic motor to rotate the rotating shaft 74 in the direction opposite the direction described above. The motor generator 7 operates as a generator and the generated power is charged in the battery 8 via the charging circuit 25. Namely, the energy is regenerated.

In this process, the pressure of hydraulic oil in the bottom oil chamber 35 becomes high, and thus the hydraulic oil flows into the first port 51 via the first oil line 33 to move the piston 78 upward. For example, as the piston 78 moves from the bottom dead point to the top dead point (revolves in the Y2 direction), the hydraulic oil is supplied from the bottom oil chamber 35 of the hydraulic cylinder 16 to the first port 51 via the first oil line 33. The pressurized oil gradually flows through the notch 51*b* into the first port 51 and then into the cylinder chamber 77 via the communication hole 84 to push up the piston 78. This minimizes an initial pressure rise and suppresses noise or the like created by a sudden movement of the piston 78. The cylinder block 75 is thereby rotated in the Y2 direction. The rotating shaft 74 thereby rotates together in the Y2 direction to drive the motor 7 as a generator.

Since the oil pressure in the rod oil chamber 36 is lower than the oil pressure in the bottom oil chamber 35 of the hydraulic cylinder 16, the hydraulic oil in the cylinder chamber 77 at the second port 52 is supplied to the rod oil chamber 36. In this process, the hydraulic oil flows into the second port 52 through the notch 52*b*, and thus the noise is reduced. The hydraulic oil in the cylinder chamber 77 at the front third port 53 is supplied to the oil tank 9 via the third oil line 41, while the shortage in the hydraulic oil in the rod oil chamber 36 is supplemented by the hydraulic oil supplied from the oil tank 9 via the drain oil line 63, the bypass oil line 62, and the second oil line 34.

Regeneration is also performed by the hydraulic cylinder 16 being extended in an extending operation during working. In such an operation, the motor 7 operates not as a motor but as a generator to regenerate energy by rotation of the cylinder block 75 of the hydraulic pump/motor 32 in the same aforementioned direction (the Y1 direction).

That is, when the manipulation lever 19 is turned in the direction to extend the hydraulic cylinder 16 (in the X2 direction) by the weight of the working machine or a load, for example, the pressure sensor 26 detects the oil pressure P1 in the bottom oil chamber 35 and the pressure sensor 27 detects the oil pressure P2 in the rod oil chamber 36. If the manipulation lever 19 is turned to perform an extending operation and the value detected by the pressure sensor 26 is smaller than the value detected by the pressure sensor 27 (P1<P2), the control circuit 21 determines that regeneration is to be performed and switches the circuit from the driving circuit 24 to the charging circuit 25. The hydraulic pump/motor 32 now operates as a hydraulic motor to rotate the rotating shaft 74 in the same aforementioned direction to operate the motor 7 as a generator and charge the battery 8 with the generated power via the charging circuit 25. Namely, the energy is regenerated.

In this process, the pressure of hydraulic oil in the rod oil chamber 36 becomes higher than the pressure in the bottom oil chamber 35, and thus the hydraulic oil flows into the second port 52 via the second oil line 34 to move the piston 78 upward and rotate the cylinder block 75 in the Y1 direction. The rotating shaft 74 thereby rotates together in the Y1 direction to drive the motor 7 as a generator.

Since the oil pressure P2 in the rod oil chamber 36 is higher than the oil pressure P1 in the oil pressure bottom oil chamber 35 of the hydraulic cylinder 16 (P1<P2), the hydraulic oil in the cylinder chamber 77 is supplied to the bottom oil chamber 35 through the first port 51, while the shortage in the hydraulic oil in the bottom oil chamber 35 is supplemented by the hydraulic oil supplied from the oil tank 9 via the third oil line 41 and the third port 53.

During excavation and an earth crushing operation performed by lowering the boom 11, regeneration is not performed. While the manipulation lever 19 is manipulated to lower the boom 11 (turned in the direction (X1 direction) to contract the hydraulic cylinder 16), the pressure sensor 26 detects the oil pressure P1 in the bottom oil chamber 35 and the pressure sensor 27 detects the oil pressure P2 in the rod oil chamber 36. If the manipulation lever 19 is manipulated to perform a contracting operation and the value detected by the pressure sensor 26 is smaller than the value detected by the pressure sensor 27 (P1<P2), the control circuit 21 determines that the operation is an excavation and switches to the driving circuit 24 to drive the motor 7, thereby rotating the rotating shaft 74 in the Y2 direction to operate the hydraulic pump/motor 32.

The hydraulic oil in the cylinder chamber 77 is supplied to the rod oil chamber 36 via the second port 52 and the second oil line 34 to contract the hydraulic cylinder 16. The hydraulic oil from the front third port 53F and the rear third port 53R is supplied to the oil tank 9 via the third oil line 41. The hydraulic oil in the bottom oil chamber 35 flows into the first port 51 via the first oil line 33.

Now a radial piston hydraulic pump/motor 130 including plungers (pistons) as the pushing members radially arranged about an axis that is eccentric to the rotating shaft will be described.

Figure 6:
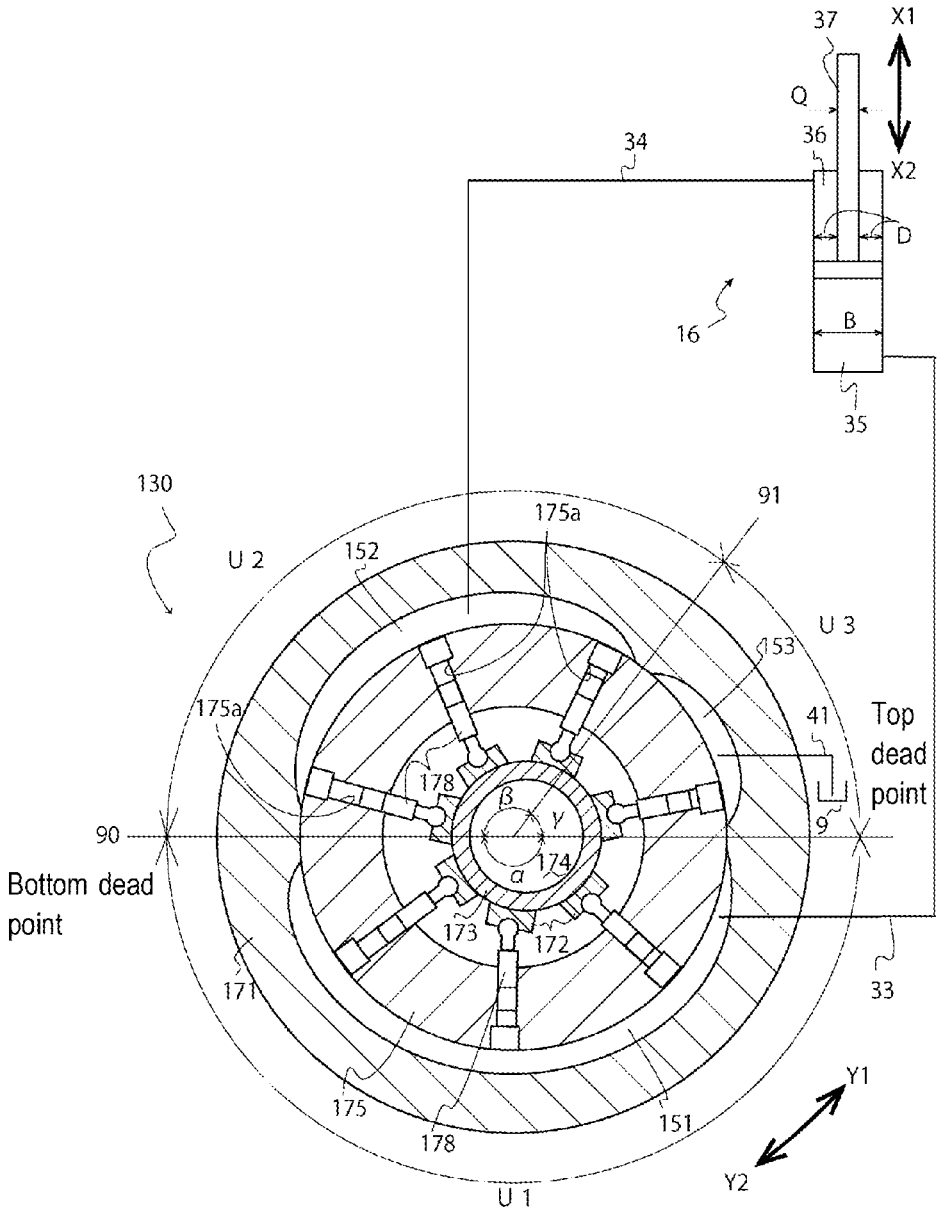
FIG. 6 is a sectional view of a radial piston hydraulic pump/motor including pistons supported in the inner circumference.

As illustrated in FIG. 6, the hydraulic pump/motor 130 includes a cylinder block 175 rotatably accommodated in a housing body 171 and a first port 151, a second port 152, and a third port 153 provided between the cylinder block 175 and the housing body 171. The cylinder block 175 has on its one end a rotating shaft coupled to an output shaft of a motor generator 7 to be rotatably driven or to be rotated for regeneration.

The cylinder block 175 includes cylinder chambers 175*a*, 175*a* . . . provided in a radial arrangement. In other words, the cylinder chambers 175*a*, 175*a* . . . each formed in a radially extending through hole are provided at every predetermined angle in the cylinder block 175. The cylinder chamber 175*a* communicates via its one end with the first port 151, the second port 152, or the third port 153. Each piston 178, 178 . . . is slidably disposed at the other end in each cylinder chamber 175*a*, 175*a* . . . .

A supporting shaft 174 eccentric to the axis of the cylinder block 175 is provided inside the cylinder block 175 with a space therebetween. The supporting shaft 174 is supported by the housing 171. A rotor 173 is rotatably supported on the supporting shaft 174 via a bearing. A plurality of piston shoes 172, 172 . . . are secured onto the outer circumference of the rotor 173 at a predetermined interval (at the same predetermined angle as the cylinder chambers 175*a*). An end of the piston 178 is pivotally engaged with the piston shoe 172, 172 . . . .

Similar to the axial piston hydraulic pump/motor, the first port 151 is provided in a first designated section U1 on the housing 171, the second port 152 in a second designated section U2 on the housing 171, and the third port in a third designated section U3 on the housing 171. Note that, the second designated section U2 where the second port 152 is provided and the third designated section U3 where the third port 153 is provided can be arranged in the opposite order with respect to the rotational direction.

Figure 7:
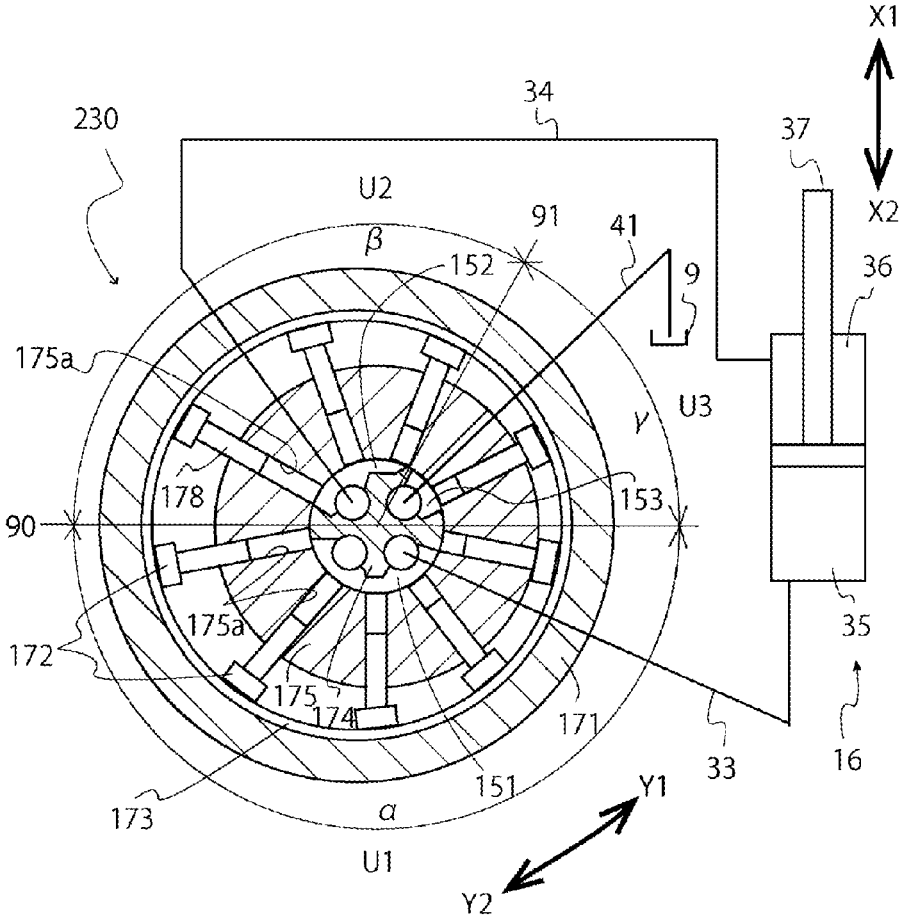
FIG. 7 is a sectional view of a radial piston hydraulic pump/motor including pistons supported in the outer circumference.

The configuration of a radial piston hydraulic pump/motor 230 including pistons supported in the outer circumference will now be described with reference to FIG. 7.

The hydraulic pump/motor 230 includes a cylinder block 175 rotatably supported on a supporting shaft 174 including cylinder chambers 175*a*, 175*a* . . . provided in a radial arrangement. A ring-shaped rotor 173 eccentrically surrounding the outer circumference of the cylinder block 175 is provided. Piston shoes 172, 172 . . . are provided on the inner circumference of the rotor 173 with the pistons 178, 178 . . . slidably inserted from the outer side in the cylinder block 175. A first port 151, a second port 152, and a third port 153 are provided in the supporting shaft 174. Similar to the embodiment described above, a first designated section U1, a second designated section U2, and a third designated section U3 are provided. The first port 51 is provided in the first designated section U1, the second port 52 is provided in the second designated section U2, and the third port 53 is provided in the third designated section U3.

In the radial piston hydraulic pump/motor 130 including pistons supported in the inner circumference and the radial piston hydraulic pump/motor 230 including pistons supported in the outer circumference, the first port 151 is connected to the bottom oil chamber 35, the second port 152 is connected to the rod oil chamber 36, and the third port 153 is connected to the oil tank 9. Similar to the axial piston hydraulic pump/motor 30, a first switching point 91 is set according to the stroke percentage to provide to operate in a similar manner. Regeneration is performed in a manner similar to the aforementioned embodiment.

A vane hydraulic pump/motor 330 can operate in a similar manner.

Figure 8:
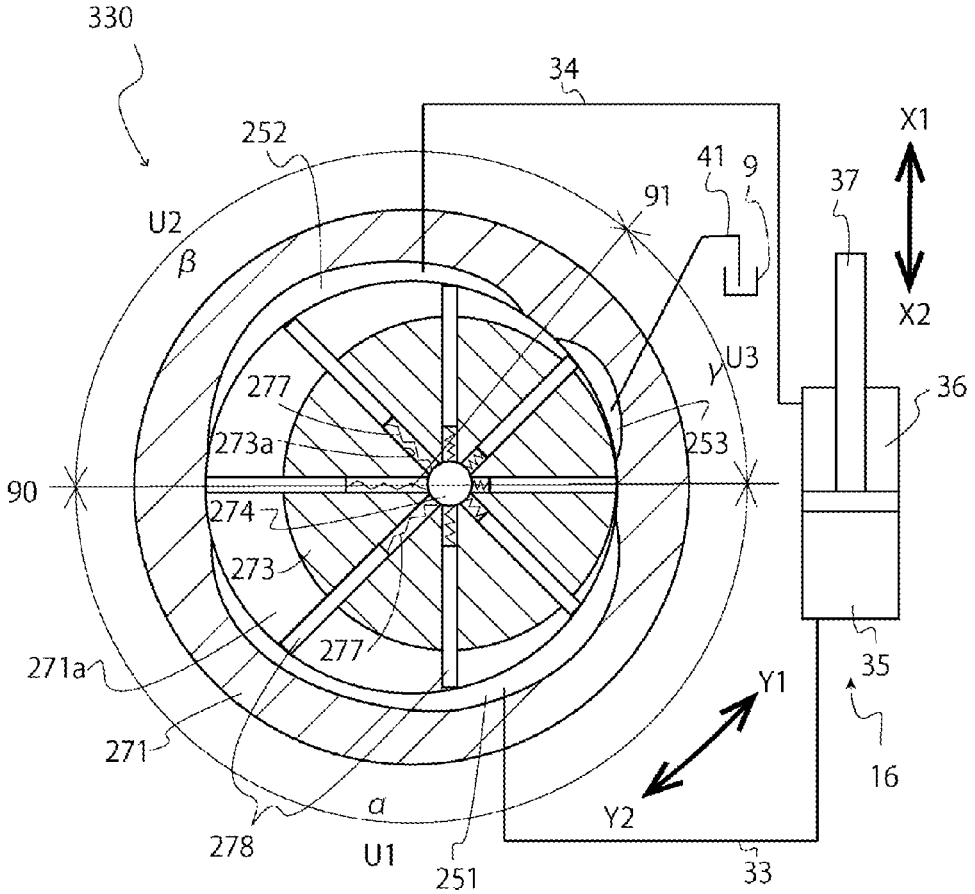
FIG. 8 is a sectional view of a vane hydraulic pump/motor.

As illustrated in FIG. 8, the hydraulic pump/motor 330 includes a rotor 273 secured on a supporting shaft 274 coupled to an output shaft of a motor generator 7. The rotor 273 has a cylindrical shape with a plurality of slits 273*a*, 273*a* . . . each in which a vane (plate) 278, 278 . . . is slidably accommodated. The vane 278 is urged circumferentially outward by an urging member 277. The rotor 273 is eccentrically accommodated in a cylindrical rotor case 271*a* provided in a housing 271 with the tip of the vane 278 always in contact with the internal face of the rotor case 271*a*.

Similar to the embodiment described above, the rotor case 271*a* includes a first port 251 communicating with the bottom oil chamber 35 via a first oil line 33, a second port 252 communicating with a rod oil chamber 36 via a second oil line 34, and a third port 253 communicating with an oil tank 9 via a third oil line 41. The first port 251 is provided in a first designated section U1, the second port 252 is provided in a second designated section U2, and the third port 253 is provided in a third designated section U3. A partial-switching point 91 where the second designated section U2 and the third designated section U3 switch over is set at a point where the stroke percentage of the vane 278 of the hydraulic pump/motor 330 matches the ratio of the pressed-area D in the rod oil chamber 36 to the pressed-area B in the bottom oil chamber 35 of the hydraulic cylinder 16.

When the manipulation lever is turned in the direction to extend the hydraulic cylinder 16 (in the X1 direction), the motor generator 7 is driven if the oil pressure in the bottom oil chamber 35 is higher than the oil pressure in the rod oil chamber 36, as in the embodiment described above. The rotors 173 and 273 thereby rotate in the Y1 direction and the hydraulic oil is thereby supplied to the first port 51 from the second port 52 and the third port 53 and then is discharged into the bottom oil chamber 35 via the first oil line 33 to extend the hydraulic cylinder 16. The hydraulic oil in the rod oil chamber 36 is supplied into the rotor case via the second oil line 34 and the second port 52. The shortage of the hydraulic oil is supplemented with the hydraulic oil suctioned from the oil tank 9 via the third oil line 41. Regeneration is performed in a manner similar to the aforementioned embodiment.

The rotary hydraulic pump/motor can be operated using a meshed gear pump in a manner similar to the embodiment described above.

Figure 9:
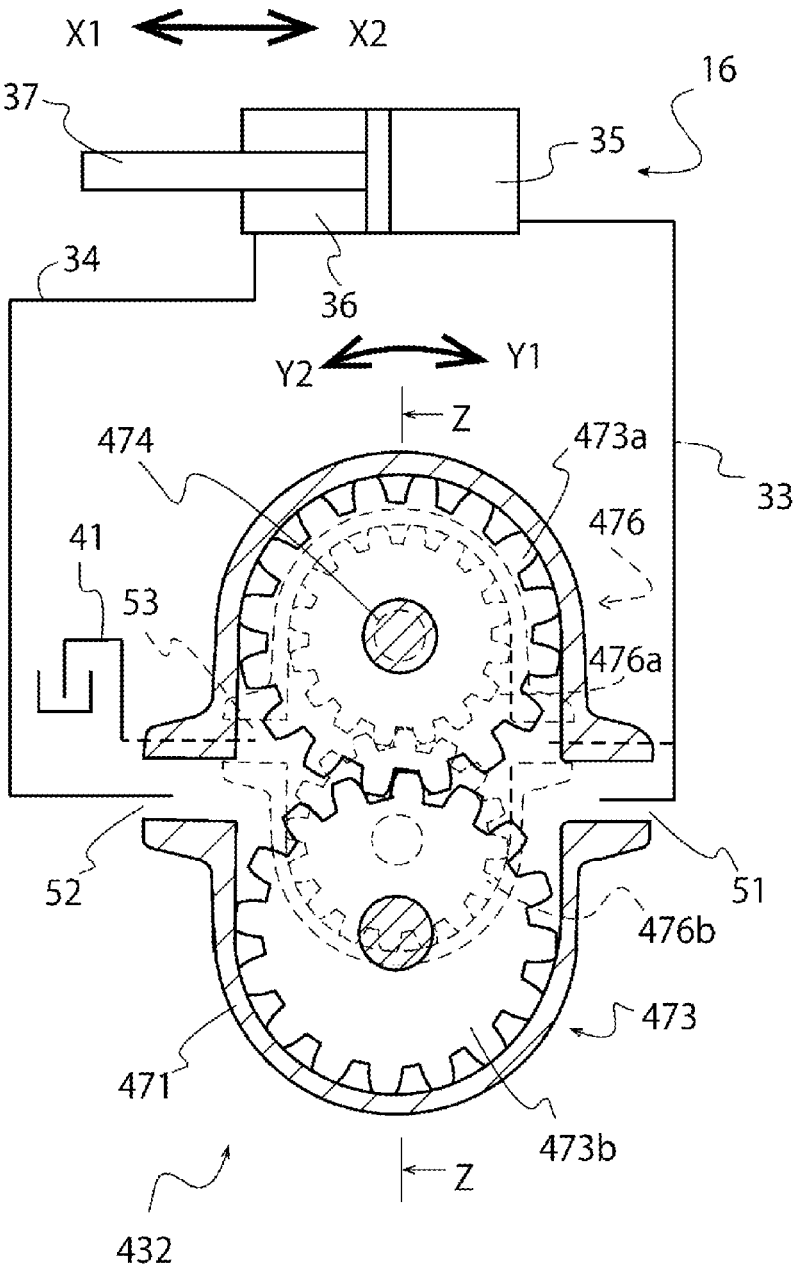
FIG. 9 is a sectional view of a parallel-meshed-gear hydraulic pump/motor.
Figure 10:
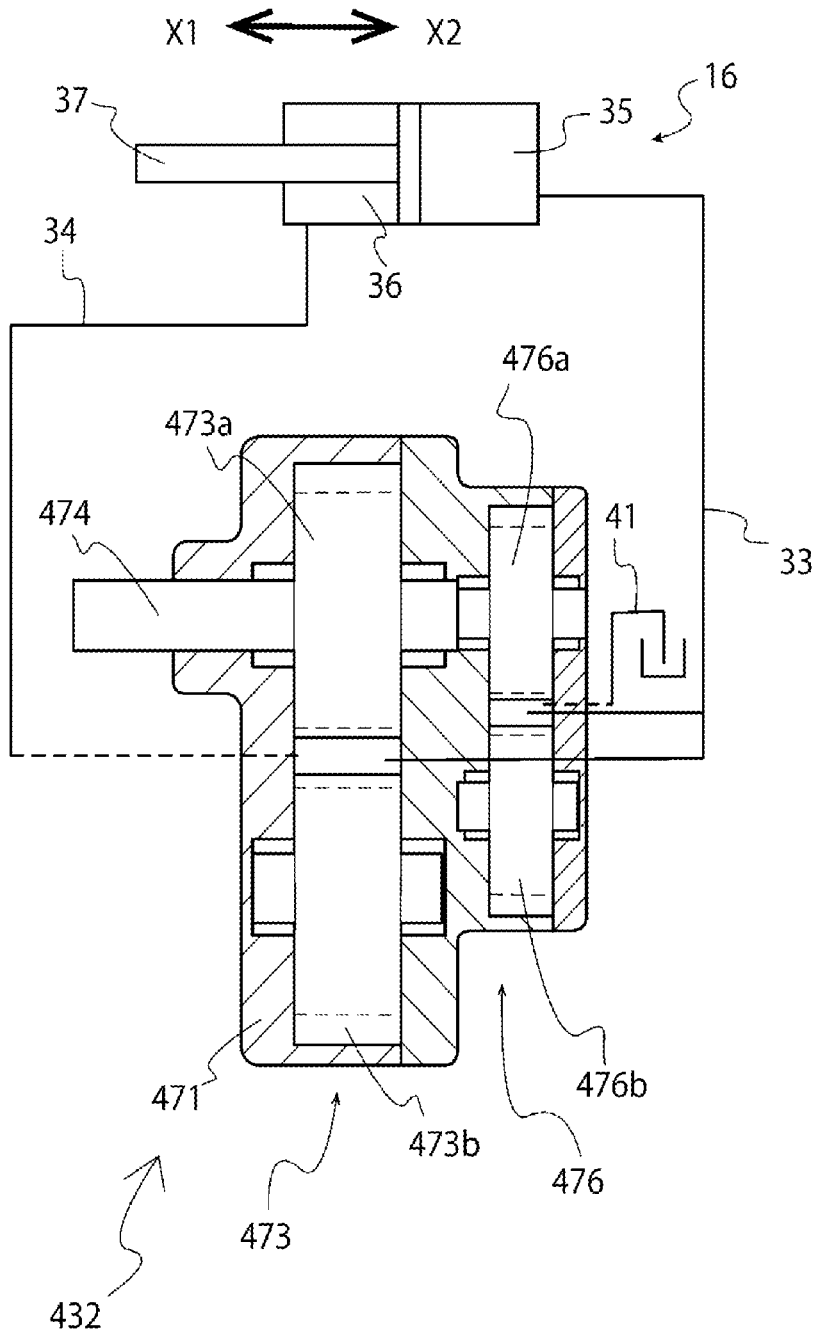
FIG. 10 is a sectional view taken along line Z-Z in FIG. 9.

As illustrated in FIGS. 9 and 10, a hydraulic pump/motor 432 includes a large set of first pumps 473 and a small set of second pumps 476 accommodated in a housing 471. The first pump 473 includes an upper external gear 473*a* and a lower external gear 473*b* which are meshed with each other, and the second pump 476 includes an upper external gear 476*a*, and a lower external gear 476*b* which are meshed with each other. The upper external gears 473*a* and the 476*a*, are secured on a supporting shaft 474.

One of left and right sides of the meshed portions between the external gears 473*a* and 473*b* and between the external gears 476*a*, and 476*b* serves as a first port 51 communicating with a bottom oil chamber 35 via a first oil line 33. The other sides of the first pump 473, which has a larger capacity, serves as a second port 52 communicating with a rod oil chamber 36 via a second oil line 34. The other side of the second pump 476, which has a smaller capacity, serves as a third port 53 communicating with an oil tank 9 via a third oil line 41. The ratio of discharge amount of the first pump 473 to the second pump 476 is set the same as the ratio of the pressed-area B in the bottom oil chamber 35 to the pressed-area D in the rod oil chamber 36. Two sets, a large and a small, of trochoid pumps may be used to function in the same manner.

By turning the manipulation lever in the direction to extend the hydraulic cylinder 16 (in the X1 direction), the motor generator 7 is driven to rotate the supporting shaft 474 in the Y1 direction, thereby rotating the external gears 473*a*, 473*b*, 476*a*, and 476*b*. The hydraulic oil in the space surrounded by the external gears 473*a*, 473*b*, 476*a*, and 476*b*, and the housing 471 is transferred from the second port 52 and the third port 53 to the first port 51 to be discharged into the bottom oil chamber 35 via the first oil line 33 to extend the hydraulic cylinder 16. The hydraulic oil in the rod oil chamber 36 is supplied to the first pump 473 via the second oil line 34 and the second port 52. The shortage of the hydraulic oil in the second pump 476 is supplemented with the hydraulic oil supplied from the oil tank 9 via the third oil line 41.

By turning the manipulation lever in the direction to contract the hydraulic cylinder 16 (in the X2 direction), the motor 7 and the supporting shaft 474 are rotated in the opposite direction (in the Y2 direction), thereby supplying the hydraulic oil in the space surrounded by the external gears 473*a*, 473*b*, 476*a*, and 476*b* and the housing 471 to the rod oil chamber 36 via the second port 52 and the second oil line 34 to contract the hydraulic cylinder 16. The hydraulic oil in the bottom oil chamber 35 is supplied to the first port 51 via the first oil line 33 and then to the oil tank 9 from the third port 53 of the second pump 476 via the third oil line 41. Regeneration is performed in a manner similar to the aforementioned embodiment.

As described above, the first hydraulic pump/motor 30, the second hydraulic pump/motor 31, and the third hydraulic pump/motor 32 are each configured using a rotatably driven axial piston hydraulic pump/motor, a radial piston hydraulic pump/motor, a vane hydraulic pump/motor, or a geared hydraulic pump/motor. The discharge/suction ports of double-acting single-rod cylinders, which are the boom cylinder 16, the arm cylinder 17, and the bucket cylinder 18 communicate respectively with the discharge/suction ports of the first hydraulic pump/motor 30, the second hydraulic pump/motor 31, and the third hydraulic pump/motor 32 each via the oil lines 33 and 34 to constitute a closed hydraulic oil circuit. For each of the boom cylinder 16, the arm cylinder 17, and the bucket cylinder 18, the ratio of the pressed-area B in the bottom oil chamber 35 to the pressed-area R in the rod oil chamber 36 is set identical to the ratio of the amount of hydraulic oil suctioned into or discharged from the bottom oil chamber 35 to the amount of hydraulic oil discharged from or suctioned into the rod oil chamber 36 by a single revolution of the pushing member of corresponding one of the first hydraulic pump/motor 30, the second hydraulic pump/motor 31, and the third hydraulic pump/motor 32. Thus, no cavitation or the like occurs during an operation and the hydraulic cylinder can operate efficiently.

The first hydraulic pump/motor 30, the second hydraulic pump/motor 31, and the third hydraulic pump/motor 32 are respectively coupled to the first motor generator 7, the second motor generator 107, and the third motor generator 207 to be driven. The boom cylinder 16, the arm cylinder 17, and the bucket cylinder 18 are driven independently and regenerate energy independently. So that, in such a state that at least one of the boom cylinder 16, the arm cylinder 17, and the bucket cylinder 18 is driven by the motor generator and at least one of other cylinders performs regeneration at the same time, the cylinder or cylinders are driven and the motor generator or motor generators regenerate at the same time without interference.

Figure 11:
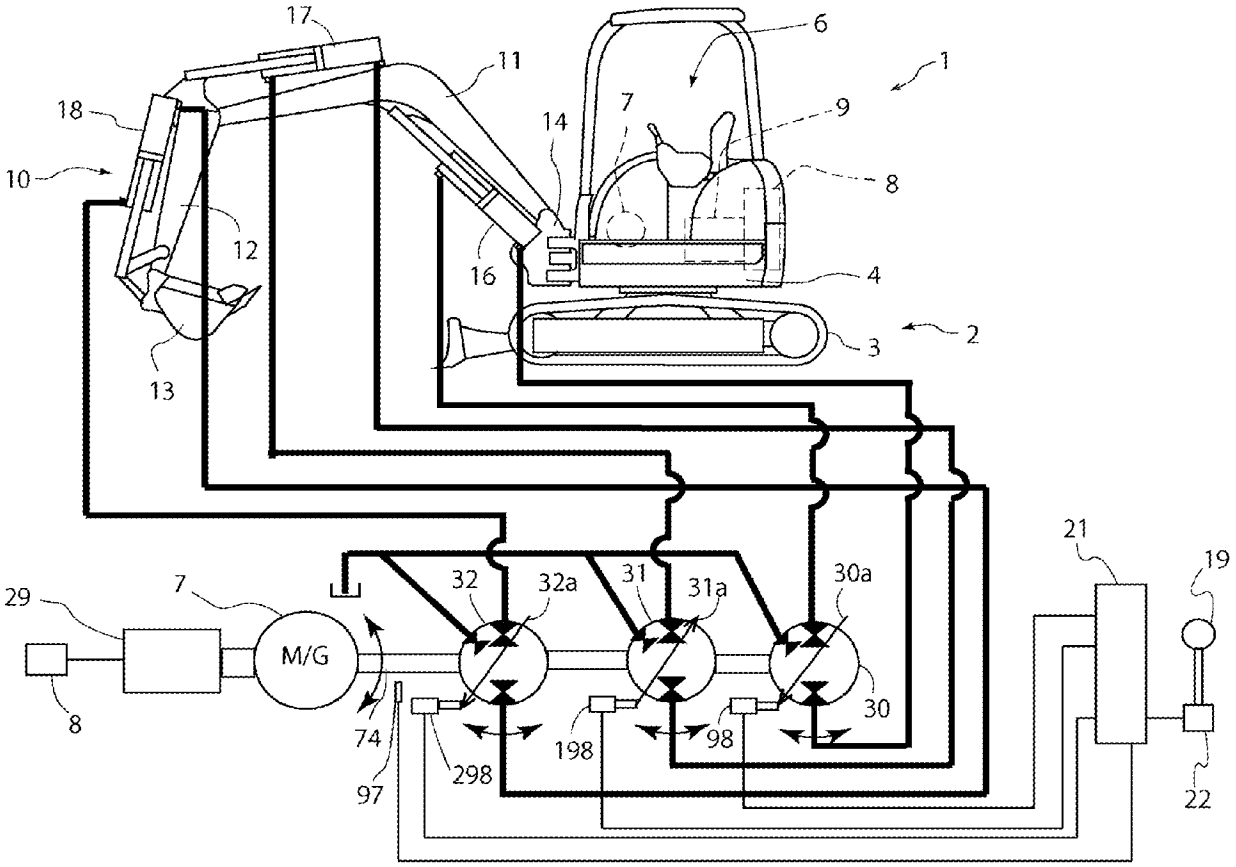
FIG. 11 illustrates connection between a motor-driven backhoe and hydraulic apparatuses according to another embodiment.

As illustrated in FIG. 11, the driving shafts of the first hydraulic pump/motor 30, the second hydraulic pump/motor 31, and the third hydraulic pump/motor 32 may be configured to be coupled to a single rotating shaft 74 coupled to the output shaft of the motor generator 7, with the first hydraulic pump/motor 30, the second hydraulic pump/motor 31, and the third hydraulic pump/motor 32 provided as axial piston hydraulic pump/motors respectively including movable swash plates 30*a*, 31*a*, and 32*a* that are tilted to change the operating speed and the direction of motion, extending or contracting, of the boom cylinder 16, the arm cylinder 17, and the bucket cylinder 18.

In this configuration, the boom cylinder 16, the arm cylinder 17, and the bucket cylinder 18 can be operated individually (independently) or in combination by driving the motor generator 7 and tilting the movable swash plates 30*a*, 31*a*, and/or 32*a* of the first hydraulic pump/motor 30, the second hydraulic pump/motor 31, and/or the third hydraulic pump/motor 32.

When one of the boom cylinder 16, the arm cylinder 17, and the bucket cylinder 18 is extended or contracted by a load or a gravitational force, one of the first hydraulic pump/motor 30, the second hydraulic pump/motor 31, and the third hydraulic pump/motor 32 corresponding to the extended or contracted cylinder is rotated by supplied hydraulic oil. In this state, if none of the boom cylinder 16, the arm cylinder 17, and the bucket cylinder 18 is driven by the motor generator 7, the motor generator 7 takes the output (rotational power) from the rotated hydraulic pump/motor to charge the battery 8 via the inverter 29, that is, regeneration is performed.

When one of the boom cylinder 16, the arm cylinder 17, and the bucket cylinder 18 is extended or contracted by a load or a gravitational force, one of the first hydraulic pump/motor 30, the second hydraulic pump/motor 31, and the third hydraulic pump/motor 32 corresponding to the extended or contracted cylinder is rotated by supplied hydraulic oil. In this state, if one of the boom cylinder 16, the arm cylinder 17, and the bucket cylinder 18 is driven by the motor generator 7 and the output (the energy regenerated by extension or contraction caused by a load or a gravitational load) is greater than the driving power of the motor generator 7, the surplus power is stored in the battery 8. If the output is smaller than the driving power of the motor generator 7, the motor generator 7 assists the driving of another cylinder. This assist will be described later.

Figure 12:
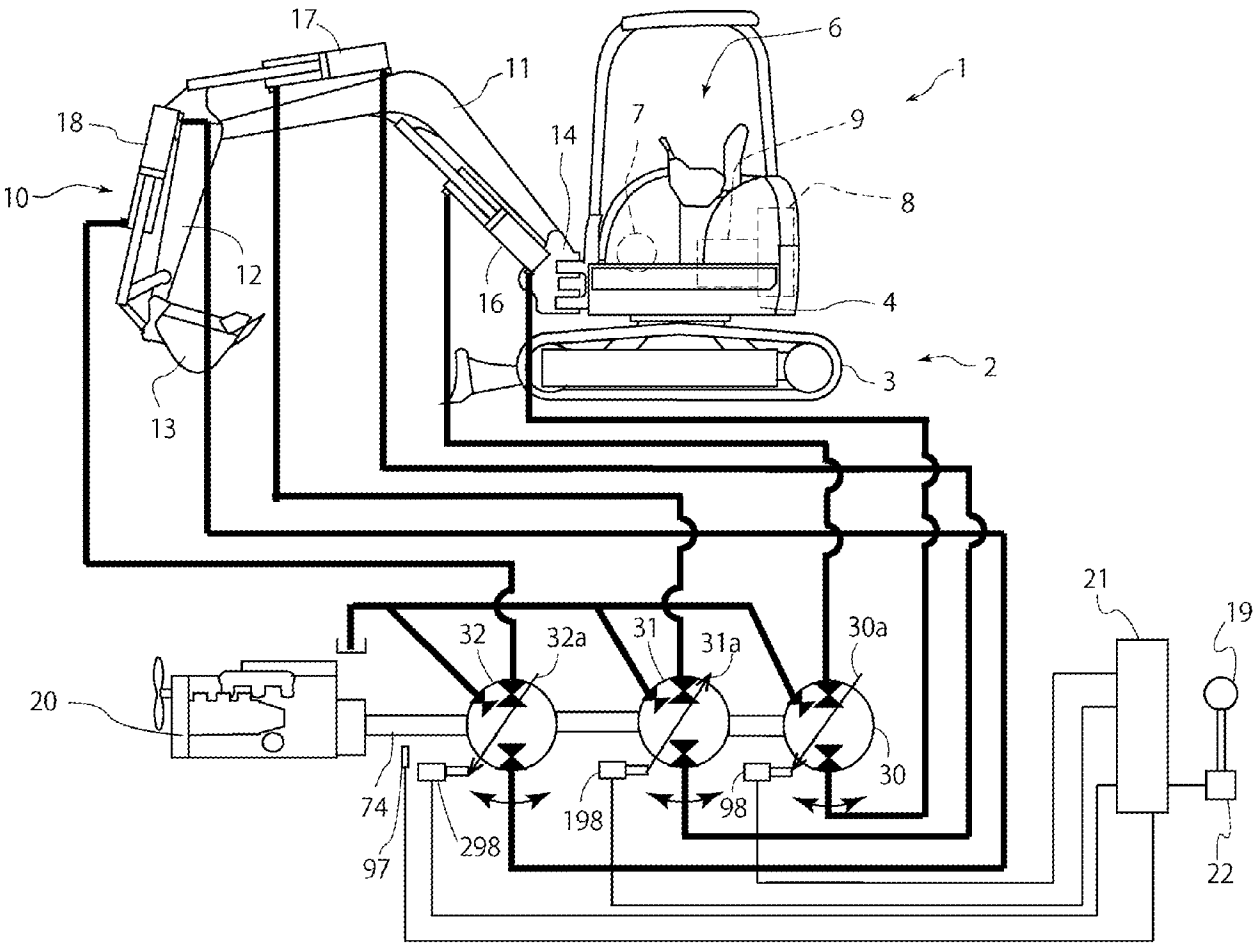
FIG. 12 illustrates connection between an engine-driven backhoe and hydraulic apparatuses according to another embodiment.

As illustrated in FIG. 12, the first hydraulic pump/motor 30, the second hydraulic pump/motor 31, and the third hydraulic pump/motor 32, which are axial piston hydraulic pump/motors respectively including movable swash plates 30*a*, 31*a*, and 32*a*, aligned along an axis can be coupled to the output shaft of an engine 20 to be driven, with the boom cylinder 16, the arm cylinder 17, and the bucket cylinder 18 configured to be driven independently by tilting the movable swash plate 30*a*, 31*a*, and/or 32*a*.

This configuration may be such that, when one of the boom cylinder 16, the arm cylinder 17, and the bucket cylinder 18 is extended or contracted by a load or a gravitational force and one of the first hydraulic pump/motor 30, the second hydraulic pump/motor 31, and the third hydraulic pump/motor 32 corresponding to the extended or contracted cylinder is rotated by supplied hydraulic oil (driven by regenerated energy), the hydraulic pump/motor that is rotated assists one of the first hydraulic pump/motor 30, the second hydraulic pump/motor 31, and/or the third hydraulic pump/motor 32 that is driven by the engine 20.

That is, to assist one of the first hydraulic pump/motor 30, the second hydraulic pump/motor 31, and the third hydraulic pump/motor 32 when one of the first hydraulic pump/motor 30, the second hydraulic pump/motor 31, and the third hydraulic pump/motor 32 is driven by a regenerative energy produced by a load or a gravitational force, a rotational speed sensor 97 connected to the control circuit 21 detects the rotational speed of the rotating shaft 74 of the first hydraulic pump/motor 30, the second hydraulic pump/motor 31, and the third hydraulic pump/motor 32. The movable swash plates 30*a*, 31*a*, and 32*a* are respectively coupled to actuators 98, 198, and 298 each configured with a motor, a solenoid, or the like. The actuators 98, 198, and 298 drive the movable swash plates 30*a*, 31*a*, and 32*a* and are connected to the control circuit 21.

During extension and contraction of one of the boom cylinder 16, the arm cylinder 17, and the bucket cylinder 18 by a load or a gravitational force in such a configuration, whether energy is regenerated is determined according to the turning direction of the manipulation lever 19 and the values detected by the pressure sensors 26 and 27. If energy is not regenerated, the engine 20 drives the hydraulic pump/motor as described above. If one of the hydraulic pump/motors is regenerating energy and one of the other hydraulic pump/motors is not regenerating energy, the regenerating hydraulic pump/motor assists the hydraulic pump/motor not regenerating energy. For example, if the boom cylinder 16 is regenerating energy and the engine 20 (or the motor generator 7) is driving the arm cylinder 17, the rotational speed sensor 97 detects the rotational direction and speed of the rotating shaft 74 and the actuator 98 operates the movable swash plate 30*a* of the first hydraulic pump/motor 30 to adjust the rotational direction and speed of the rotating shaft 74 to assist the second hydraulic pump/motor 31. If every hydraulic pump/motor is regenerating energy, no assist nor charging can be performed.

Therefore, pressure interference can be avoided under a combined operation of the boom cylinder 16, the arm cylinder 17, and the bucket cylinder 18. This improves operability and reduces a power loss.

INDUSTRIAL APPLICABILITY

The present invention can be used in a construction machine, a farming machine, or the like that includes a hydraulic apparatus that is operated by a hydraulic cylinder and a hydraulic pump/motor connected within a closed hydraulic oil circuit.

DESCRIPTION OF REFERENCE SIGNS

B: Pressed-area in bottom oil chamber
R: Pressed-area in rod oil chamber
Q: Piston rod sectional area
7: Motor generator
16: Boom cylinder (hydraulic cylinder)
17: Arm cylinder
18: Bucket cylinder
30: First hydraulic pump/motor
31: Second hydraulic pump/motor

32: Third hydraulic pump/motor
33: First oil line
34: Second oil line
35: Bottom oil chamber
36: Rod oil chamber
37: Piston rod
51: First port
52: Second port
53: Third port
74: Rotating shaft

The invention claimed is:

1. A hydraulic apparatus comprising:

double-acting single-rod cylinders, which are a boom cylinder, an arm cylinder, and a bucket cylinder; and rotationally driven hydraulic pump/motors, which are a first hydraulic pump/motor, a second hydraulic pump/motor, and a third hydraulic pump/motor, wherein:

the first hydraulic pump/motor, the second hydraulic pump/motor, and the third hydraulic pump/motor are coupled to a single driving shaft coupled to an output shaft of an engine or a motor, inflow/outflow ports of the boom cylinder communicate with discharge/suction ports of the first hydraulic pump/motor via oil lines to constitute a closed hydraulic oil circuit, inflow/outflow ports of the arm cylinder communicate with discharge/suction ports of the second hydraulic pump/motor via oil lines to constitute a closed hydraulic oil circuit, and inflow/outflow ports of the bucket cylinder communicate with discharge/suction ports of the third hydraulic pump/motor via oil lines to constitute a closed hydraulic oil circuit, each closed hydraulic oil circuit comprising a corresponding single hydraulic pump/motor comprising axial piston hydraulic pump/motor including a movable swash plate, an operating speed and a direction of motion, extending or contracting, of the boom cylinder, the arm cylinder, and the bucket cylinder are changed by tilting the movable swash plates, and for each of the boom cylinder, the arm cylinder, and the bucket cylinder, a ratio of a pressed-area in a bottom oil chamber to the pressed-area in a rod oil chamber is set identical to a ratio of an amount of hydraulic oil suctioned into or discharged from the bottom oil chamber to an amount of hydraulic oil discharged from or suctioned into the rod oil chamber by a single revolution of a pushing member of corresponding one of the first hydraulic pump/motor, the second hydraulic pump/motor, and the third hydraulic pump/motor; and wherein at least one of the discharge/suction ports of at least one of the first hydraulic pump/motor, the second hydraulic pump/motor, or the third hydraulic pump/motor define an arc slit having:

a first triangular notch at a first end, a second triangular notch at a second end, or both.

2. The hydraulic apparatus according to claim 1, wherein:

rotating shafts of the first hydraulic pump/motor, the second hydraulic pump/motor, and the third hydraulic pump/motor are respectively coupled to the single driving shaft to be driven, and the boom cylinder, the arm cylinder, and the bucket cylinder can independently be driven and can independently regenerate energy.

3. The hydraulic apparatus according to claim 1, wherein when the boom cylinder, the arm cylinder, or the bucket cylinder contracts by a load or a gravitational force, hydraulic oil is supplied to the first hydraulic pump/motor, the second hydraulic pump/motor, or the third hydraulic pump/motor, respectively, to output energy.

4. The hydraulic apparatus according to claim 3, wherein when at least one of the first hydraulic pump/motor, the second hydraulic pump/motor, and the third hydraulic pump/motor is driven by an engine or a motor and at least one of other hydraulic pump/motors is driven by pressurized oil from the cylinder contracting by a load or a gravitational force to regenerate energy, the regenerated energy is used for assisting the engine or the motor or charging.

5. The hydraulic apparatus according to claim 1, wherein each hydraulic pump/motor is coupled to a corresponding cylinder via the discharge/suction ports, the discharge/suction ports comprising:

a first port directly coupled to a bottom oil chamber of the corresponding cylinder;

a second port directly coupled to a rod oil chamber of the corresponding cylinder; and a third port directly coupled to an oil tank.

6. The hydraulic apparatus according to claim 1, wherein each closed hydraulic oil circuit comprises:

a drain oil line coupled to an oil tank;

a first check valve coupled to a first oil line and to the drain oil line;

a first relief valve coupled in parallel with the first check valve to the first oil line and to the drain oil line;

a second check valve coupled to a second oil line and to the drain oil line; and a second relief valve coupled in parallel with the second check valve to the second oil line and to the drain oil line.

7. The hydraulic apparatus according to claim 1, wherein each of the first triangular notch and the second triangular notch has a width and a depth that decrease toward a corresponding distal end of each of the triangular notches.

8. The hydraulic apparatus according to claim 1, wherein the arc slit has both the first triangular notch at the first end and the second triangular notch at the second end.

9. A hydraulic apparatus comprising:

an oil tank;

a single driving shaft coupled to an output shaft of an engine or a motor;

one or more closed hydraulic oil circuits comprising:

a double-acting single-rod cylinder comprising a boom cylinder, an arm cylinder, or a bucket cylinder, the double-acting single-rod cylinder including:

a bottom oil chamber; and a rod oil chamber; and a rotationally driven hydraulic pump/motor coupled to the single driving shaft and comprising an axial piston hydraulic pump/motor, the rotationally driven hydraulic pump/motor comprising:

a movable swash plate, wherein an operating speed and a direction of motion, extending or contracting, of the double-acting single-rod cylinder are changed by tilting the movable swash plate; and a valve plate having:

a first discharge/suction port coupled to an inflow/outflow port of the bottom oil chamber via a first oil line;

a second discharge/suction port coupled to an inflow/outflow port of the rod oil chamber via a second oil line; and a third discharge/suction port coupled to the oil tank, wherein each of the first discharge/suction port, the second discharge/suction port, and the third discharge/suction port of the valve plate comprises:

an arc slit of the same width;

a first end notch coupled to a first end of the arc slit; and a second end notch coupled to a second end of the arc slit;

wherein each of the first end notch and the second end notch has a width and a depth that decrease toward a corresponding distal end of the end notch; and a ratio of a pressed-area in the bottom oil chamber to a pressed-area in the rod oil chamber is set identical to a ratio of an amount of hydraulic oil suctioned into or discharged from the bottom oil chamber to an amount of hydraulic oil discharged from or suctioned into the rod oil chamber by a single revolution of a pushing member of a corresponding pump/motor.

10. The hydraulic apparatus of claim 9, wherein the one or more closed hydraulic oil circuits comprise:

a first closed hydraulic oil circuit;

a second closed hydraulic oil circuit; and a third closed hydraulic oil circuit.

11. The hydraulic apparatus of claim 10, wherein:

the double-acting single-rod cylinder of the first closed hydraulic oil circuit comprises the boom cylinder;

the double-acting single-rod cylinder of the second closed hydraulic oil circuit comprises the arm cylinder; and the double-acting single-rod cylinder of the third closed hydraulic oil circuit comprises the bucket cylinder.

12. The hydraulic apparatus of claim 9, wherein the movable swash plate comprises:

a first section associated with the first discharge/suction port of the rotationally driven hydraulic pump/motor;

a second section associated with the second discharge/suction port of the rotationally driven hydraulic pump/motor; and a third section associated with the third discharge/suction port of the rotationally driven hydraulic pump/motor.

13. The hydraulic apparatus of claim 9, wherein an arc length of each of the first discharge/suction port, the second discharge/suction port, and the third discharge/suction port is different.

14. A hydraulic apparatus comprising:

an oil tank;

a single driving shaft coupled to an output shaft of an engine or a motor; and one or more closed hydraulic oil circuits comprising a double-acting single-rod cylinder comprising:

a bottom oil chamber; and a rod oil chamber; and a rotationally driven hydraulic pump/motor coupled to the single driving shaft, the rotationally driven hydraulic pump/motor comprising:

a first discharge/suction port coupled to an inflow/outflow port of the bottom oil chamber via a first oil line;

a second discharge/suction port coupled to an inflow/outflow port of the rod oil chamber via a second oil line; and a third discharge/suction port coupled to the oil tank;

wherein:

at least one of the first discharge/suction port, the second discharge/suction port, and the third discharge/suction port of the rotationally driven hydraulic pump/motor comprises:

an arc slit having a first end and a second end; and a first end notch coupled to the first end; and the first end notch has a width and a depth that decrease toward a corresponding distal end of the first end notch.

15. The hydraulic apparatus of claim 14, wherein:

the at least one of the first discharge/suction port, the second discharge/suction port, and the third discharge/suction port of the rotationally driven hydraulic pump/motor further comprises:

a second end notch coupled to the second end; and the second end notch has a width and a depth that decrease toward a corresponding distal end of the second end notch; and each closed hydraulic oil circuit comprises:

a drain oil line coupled to the oil tank;

a first check valve coupled to the first oil line and to the drain oil line; and a first relief valve in parallel with the first check valve and coupled to the first oil line and to the drain oil line.

16. The hydraulic apparatus of claim 15, wherein each closed hydraulic oil circuit further comprises:

a second check valve coupled to the second oil line and to the drain oil line; and a second relief valve in parallel with the second check valve and coupled to the second oil line and to the drain oil line.

17. The hydraulic apparatus according to claim 15, wherein a ratio of a pressed-area in the bottom oil chamber to a pressed-area in the rod oil chamber is set identical to a ratio of an amount of hydraulic oil suctioned into or discharged from the bottom oil chamber to an amount of hydraulic oil discharged from or suctioned into the rod oil chamber by a single revolution of a pushing member of a corresponding pump/motor.

18. The hydraulic apparatus of claim 15, wherein the one or more closed hydraulic oil circuits comprise:

a first closed hydraulic oil circuit;

a second closed hydraulic oil circuit; and a third closed hydraulic oil circuit.

19. The hydraulic apparatus of claim 18, wherein:

the double-acting single-rod cylinder of the first closed hydraulic oil circuit comprises a boom cylinder;

the double-acting single-rod cylinder of the second closed hydraulic oil circuit comprises an arm cylinder; and the double-acting single-rod cylinder of the third closed hydraulic oil circuit comprises a bucket cylinder.

20. The hydraulic apparatus of claim 14, wherein:

the at least one of the first discharge/suction port, the second discharge/suction port, and the third discharge/suction port of the rotationally driven hydraulic pump/motor comprising comprises the first discharge/suction port; and each of the second discharge/suction port and the third discharge/suction port of the rotationally driven hydraulic pump/motor comprising comprises:

an arc slit of the same width as the arc slit of the first discharge/suction port; and an end notch coupled to an end of the arc slit and having a width and a depth that decrease toward a corresponding distal end of the end notch.

* * * * *